US011370516B2

(12) United States Patent
Ridl

(10) Patent No.: US 11,370,516 B2
(45) Date of Patent: Jun. 28, 2022

(54) MOTORIZED ROTATING TRANSDUCER MOUNT

(71) Applicant: Mark Alan Ridl, Gilbertsville, KY (US)

(72) Inventor: Mark Alan Ridl, Gilbertsville, KY (US)

( * ) Notice: Subject to any disclaimer, the term of this patent is extended or adjusted under 35 U.S.C. 154(b) by 0 days.

(21) Appl. No.: 15/929,803

(22) Filed: May 22, 2020

(65) Prior Publication Data

US 2021/0362818 A1 Nov. 25, 2021

(51) Int. Cl.
*B63H 20/00* (2006.01)

(52) U.S. Cl.
CPC ..... *B63H 20/007* (2013.01)

(58) Field of Classification Search
CPC .... B63H 20/007; B63H 21/26; B63H 21/265; B63H 21/28
See application file for complete search history.

(56) References Cited

U.S. PATENT DOCUMENTS 4,144,518 A 3/1979 Minohara et al.
4,282,590 A 8/1981 Wingate
4,339,811 A 7/1982 Bednarz et al.
4,479,206 A 10/1984 Granberg et al.
4,926,399 A * 5/1990 Hickman ..... G10K 11/006 248/230.9
5,041,030 A 8/1991 Payne, Sr.
5,231,610 A 7/1993 Barksdale, Jr. et al.
5,573,221 A * 11/1996 Reeves ..... B63H 20/007 248/640
5,737,279 A 4/1998 Carter
6,760,995 B2 7/2004 Mueller
7,495,997 B1 2/2009 Cummings
7,684,846 B2 3/2010 Johnson et al.
8,305,844 B2 11/2012 DePasqua
8,645,012 B2 2/2014 Salmon et al.
9,153,224 B2 10/2015 Bradley
9,878,769 B2 1/2018 Kinoshita et al.
10,107,908 B2 * 10/2018 Betts ..... G01S 7/521
10,151,829 B2 12/2018 Lauenstein
2009/0037040 A1 2/2009 Salmon et al.
2016/0131759 A1 5/2016 Kozuki
2016/0245915 A1 8/2016 Clark
2016/0274227 A1 * 9/2016 Wilhelm ..... G01S 7/521
2018/0217256 A1 8/2018 Stokes
2021/0056944 A1 * 2/2021 Vance ..... G10K 11/355

* cited by examiner

*Primary Examiner* — Anthony D Wiest
(74) *Attorney, Agent, or Firm* — Mark A. Pitchford; Eric B. Fugett; Pitchford Fugett, PLLC

(57) ABSTRACT

A transducer mount assembly includes a housing and a motor coupled to and disposed within the housing. An elongated rod extends from the housing and is operably coupled to the motor. The motor is configured to rotate the elongated rod about a longitudinal axis of the elongated rod in a first direction and a second direction opposite the first direction. A controller is in communication with the motor and is configured to selectively direct the motor to rotate the elongated rod in the first direction and the second direction. A boat mount bracket is configured to couple the transducer mount assembly to portion of a boat. A transducer mount bracket is configured to couple a transducer to the elongated rod.

6 Claims, 3 Drawing Sheets

MOTORIZED ROTATING TRANSDUCER MOUNT

BACKGROUND OF THE INVENTION

The present invention relates to transducers and, more particularly, to a motorized rotating transducer mount.

Sonar (SOund Navigation And Ranging) has long been used to detect waterborne or underwater objects. For example, sonar devices may be used to determine depth and bottom topography, detect fish, locate wreckage, etc. In this regard, due to the extreme limits to visibility underwater, sonar is typically the most accurate way to locate objects underwater. Sonar transducer elements, or simply transducers, convert electrical energy into sound or vibrations at a particular frequency. A sonar sound beam is transmitted into and through the water and is reflected from objects it encounters. The transducer receives the reflected sound (the "sonar returns") and converts the sound energy into electrical energy. Based on the known speed of sound, it is possible to determine the distance to and/or location of the waterborne or underwater objects. The sonar return signals can also be processed to be displayed in graphical form on a display device, giving the user a "picture" of the underwater environment. The signal processor and display may be part of a unit known as a "sonar head" that is connected by a wire to the transducer mounted remotely from the sonar head. Alternatively, the sonar transducer may be an accessory for an integrated marine electronics system offering other features such as GPS, radar, etc.

Mounting of transducers may vary depending on a number of factors, including the design of the watercraft (e.g., boat or motor) to which it may be mounted. For example, a transducer may be mounted with a transom mounting, a portable mounting, a thru-hull mounting, a trolling motor mounting, an over-the-side mounting, or other hull or structure mounting options. To change the direction, the transducer must be manually moved to the desired direction, or the transducer is mounted directly to a trolling motor. However, the direction of the transducer is directly affected by the direction of the motor, and when the motor turns the transducer may be turned towards an undesirable location.

As can be seen, there is a need for a motorized rotating transducer mount.

SUMMARY OF THE INVENTION

In one aspect of the present invention, a transducer mount comprises: a housing; a motor coupled to and disposed within the housing; an elongated rod extending from the housing and operably coupled to the motor, wherein the motor is configured to rotate the elongated rod about a longitudinal axis of the elongated rod in a first direction and a second direction opposite the first direction; a controller in communication with the motor and configured to selectively direct the motor to rotate the elongated rod in the first direction and the second direction; a boat mount bracket configured to couple the transducer mount to portion of a boat; and a transducer mount bracket configured to couple a transducer to the elongated rod.

In another aspect of the present invention, a transducer mount assembly comprises: a housing; a motor coupled to and disposed within the housing; an elongated rod extending from the housing and operably coupled to the motor, wherein the motor is configured to rotate the elongated rod about a longitudinal axis of the elongated rod in a first direction and a second direction opposite the first direction; a controller in communication with the motor and configured to selectively direct the motor to rotate the elongated rod in the first direction and the second direction; a boat mount bracket configured to couple the transducer mount to portion of a boat; a transducer mount bracket; and a transducer coupled to the elongated rod by the transducer mount bracket.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
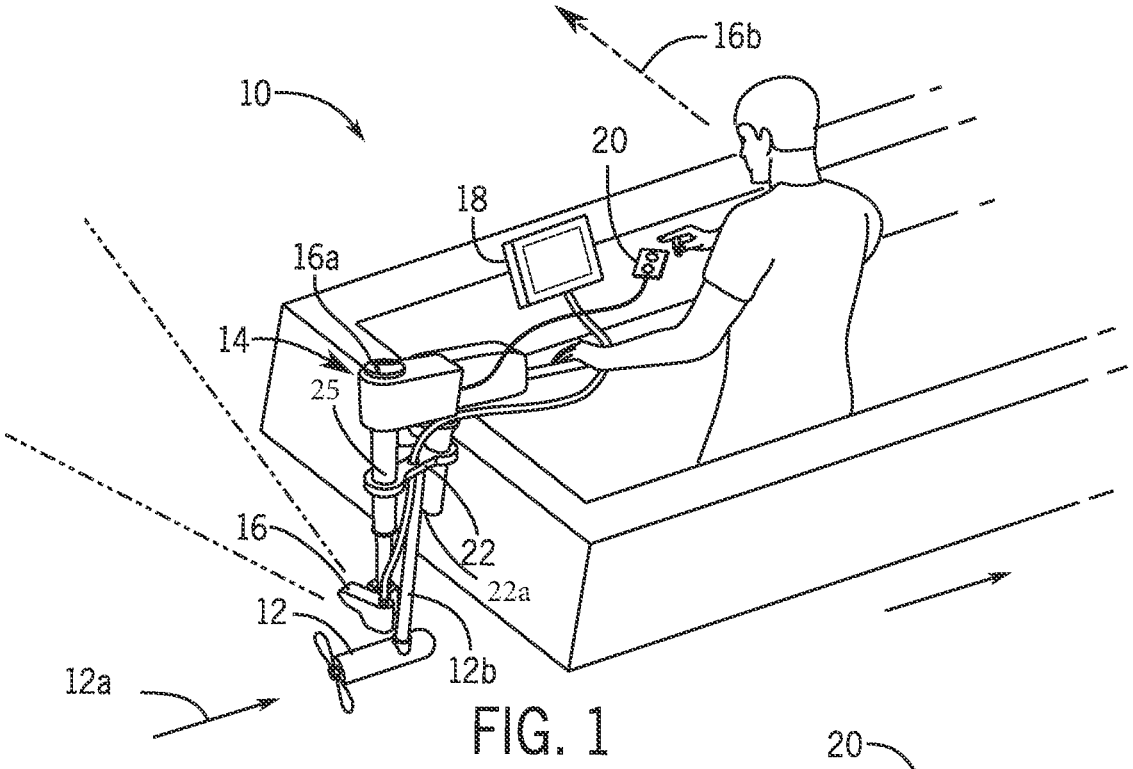
FIG. 1 is a perspective view of an embodiment of the present invention, shown in use.
Figure 4:
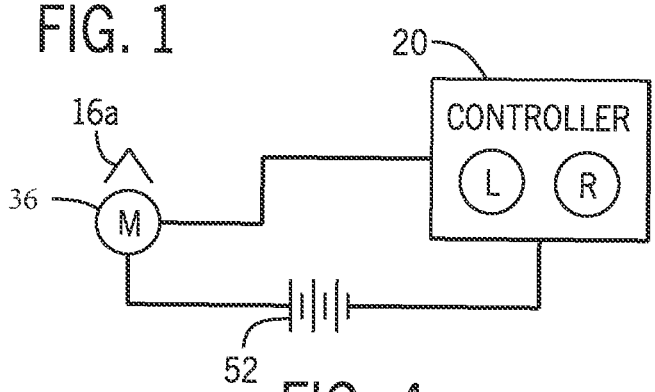
FIG. 4 is a schematic view of an embodiment of the present invention.
Figure 5A:
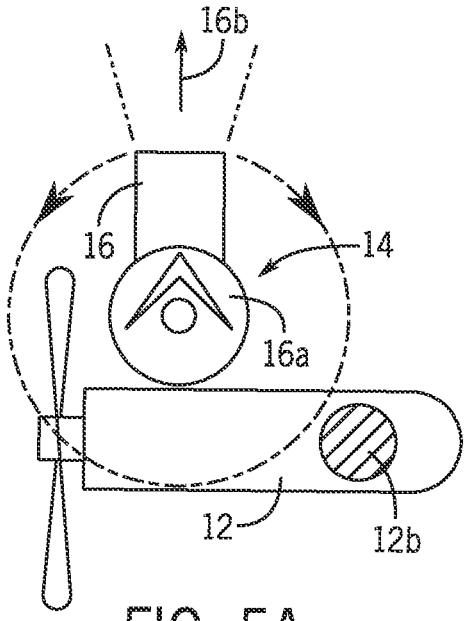
FIG. 5A is a detail top plan view of an embodiment of the present invention in a first orientation.
Figure 5B:
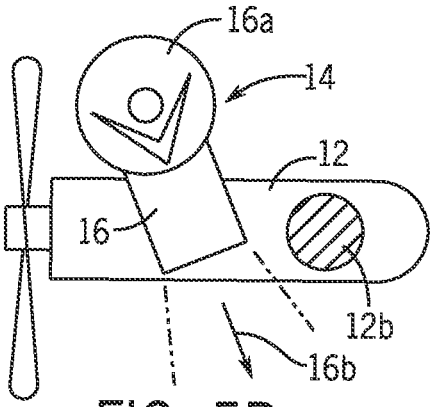
FIG. 5B is a detail top plan view of an embodiment of the present invention in a second orientation.
Figure 2:
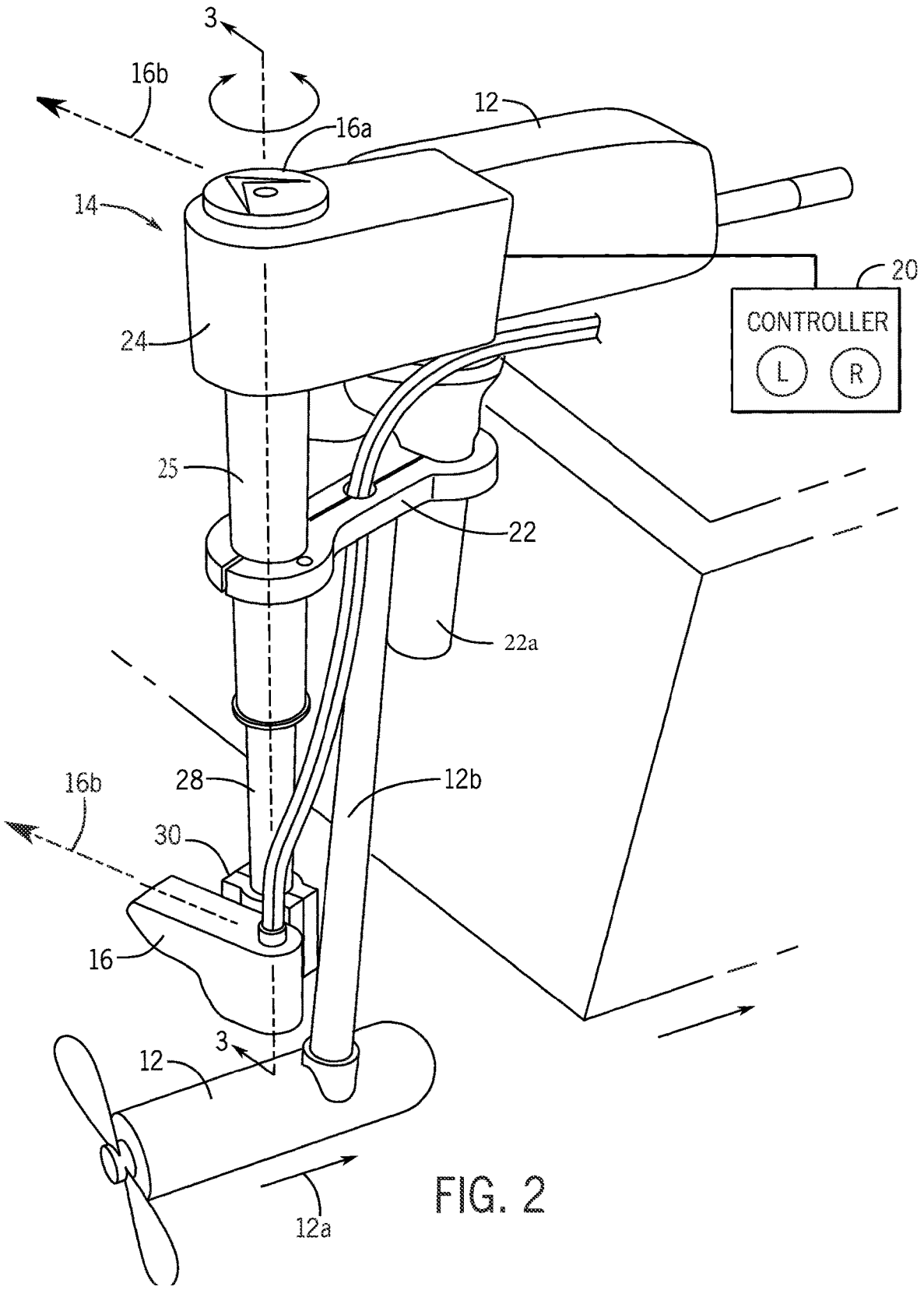
FIG. 2 is a perspective view of an embodiment of the present invention.
Figure 3:
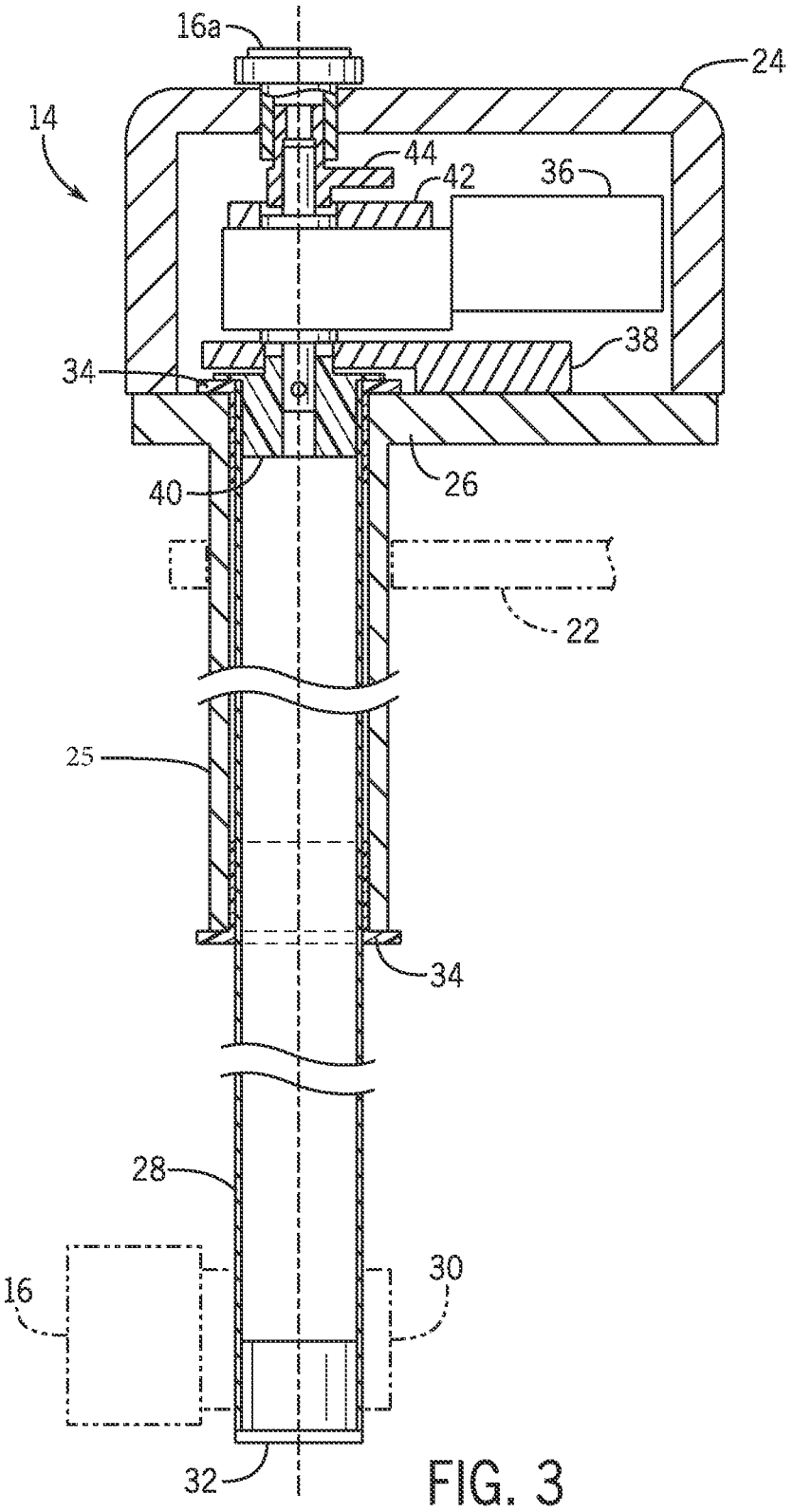
FIG. 3 is a cross-sectional view of the present invention taken along line 3-3 in FIG. 2.

Referring to FIGS. 1 through 5B, the present invention includes a transducer mount assembly 10. The transducer mount assembly 10 includes a housing 14 and a motor 36 coupled to and disposed within the housing 14. An elongated rod 28 extends from the housing 14 and is operably coupled to the motor 36. The motor 36 is configured to rotate the elongated rod 28 about a longitudinal axis of the elongated rod 28 in a first direction and a second direction opposite the first direction. A controller 20 is in communication with the motor 36 and is configured to selectively direct the motor to rotate the elongated rod 28 in the first direction and the second direction. A boat mount bracket 22 is configured to couple the transducer mount assembly 10 to portion of a boat. A transducer mount bracket 30 is configured to couple a transducer 16 to the elongated rod 28.

The housing 14 of the present invention may include a base 26 and a cover 24 defining an enclosed space. A motor mounting plate 38 may mount the motor 36 within the enclosed space. A rod sleeve 25 is attached to and extending downward from the base 26 of the housing 14. The elongated rod 28 is rotatably disposed within the rod sleeve 25 by a bushing 34. The motor 36 may rotate a motor drive block 40. The motor drive block 40 may be fixed within a hollow center of the elongated rod 28 and thereby the elongated rod 28 rotates with the motor drive block 40. A cap 32 may be secured to an opposing open end of the elongated rod 28. An indicator cap 16*a* may be rotatably coupled to a top portion of the housing 14. The indicator cap 16*a* may be rotated by a switch arm 44 that is rotatably coupled to the motor 36 by a switch mounting plate 42. The indicator cap 16*a* includes directional indicia. The indicator cap 16*a* rotates with the elongated rod 28. Therefore, the directional indicia on the indicator cap 16*a* shows which direction 16*b* the transducer 16 is pointing.

The boat mount bracket 22 may couple the transducer mount assembly 10 to a trolling motor 12. The trolling motor 12 includes propellers that propel the boat in a direction 12*a* within the water. In such embodiments, a first end of the boat mounting bracket 22 may include a first slot sized to fit the rod sleeve 25 within and a second end includes a second slot sized to fit a trolling motor sleeve 22*a* shaft 12*b* within, and thereby coupling the transducer mount assembly 10 to the trolling motor 12. The boat mount bracket 22 may further include a third slot disposed in between the first slot and the second slot. The third slot is sized to receive an electrical cable running from the transducer 16 to a monitor 18.

The controller 20 may be a remote controller having a first button to activate the motor 36 to rotate the elongated rod 28 in the first direction and a second button to activate the motor 36 to rotate the elongated rod in the second direction. When a button on the controller 20 is depressed, a battery 52 powers the motor 36 to turn in the first direction or the second direction. The controller 20 may be wired or wireless. The controller 20 may be handheld, a peddle, or another configuration.

It should be understood, of course, that the foregoing relates to exemplary embodiments of the invention and that modifications may be made without departing from the spirit and scope of the invention as set forth in the following claims.

What is claimed is:

1. A transducer mount comprising:

a housing;

a motor coupled to and disposed within the housing;

an elongated rod extending from the housing and operably coupled to the motor, wherein the motor is configured to rotate the elongated rod about a longitudinal axis of the elongated rod in a first direction and a second direction opposite the first direction;

a controller in communication with the motor and configured to selectively direct the motor to rotate the elongated rod in the first direction and the second direction;

a rod sleeve attached to and extending from a bottom of the housing, wherein the elongated rod is rotatably disposed within the rod sleeve;

a trolling motor sleeve attached to a trolling motor, wherein said trolling motor sleeve does not rotate with a trolling motor shaft of the trolling motor;

a boat mount bracket configured to couple the rod sleeve to the trolling motor sleeve by clamping onto each of the rod sleeve and the trolling motor sleeve such that a height of the housing and a height of the boat mount bracket are adjustable relative to a height of the trolling motor, and a rotational position of the rod sleeve about the trolling motor sleeve is adjustable; and a transducer mount bracket configured to couple a transducer to the elongated rod.

2. The transducer mount of claim 1, wherein the boat mount bracket comprises a first end comprising a first slot sized to fit the rod sleeve within and a second end comprising a second slot sized to fit a trolling motor sleeve within, and thereby capable of coupling the transducer mount to the trolling motor.

3. The transducer mount of claim 2, wherein the boat mount bracket further comprises a third slot disposed in between the first slot and the second slot, wherein the third slot is sized to receive an electrical cable running from the transducer to a monitor.

4. The transducer mount of claim 1, further comprising an indicator cap rotatably coupled to the housing, wherein the indicator cap comprises a directional indicia and the indicator cap rotates with the elongated rod.

5. The transducer mount of claim 1, wherein the controller is a remote controller comprising a first button to activate the motor to rotate the elongated rod in the first direction and a second button to activate the motor to rotate the elongated rod in the second direction.

6. The transducer mount of claim 1, further comprising the transducer coupled to a bottom end of the elongated rod by the transducer mount bracket.

* * * * *